United States Patent [19]

Porat

[11] Patent Number: 4,527,150

[45] Date of Patent: Jul. 2, 1985

[54] INTRUSION DETECTION SYSTEM

[75] Inventor: Chaim Porat, Beer-Sheva, Israel

[73] Assignee: Beta Engineering & Industrial Development, Beersheba, Israel

[21] Appl. No.: 430,660

[22] Filed: Sep. 30, 1982

[30] Foreign Application Priority Data

Jun. 11, 1982 [IL] Israel ..... 66040

[51] Int. Cl.[3] ..... G08B 13/12

[52] U.S. Cl. ..... 340/541; 340/666; 340/668

[58] Field of Search ..... 340/565, 541, 668, 666, 340/665

[56] References Cited

U.S. PATENT DOCUMENTS

| | | | |
|---|---|---|---|
| 2,787,784 | 4/1957 | Meryman et al. | 340/565 X |
| 3,846,780 | 11/1974 | Gilcher | 367/177 X |
| 3,867,564 | 2/1975 | Karadishian | 174/126 CP X |
| 4,075,616 | 2/1978 | Rait | 340/666 |
| 4,194,194 | 3/1980 | Redfern | 340/665 X |
| 4,209,776 | 6/1980 | Frederick | 340/541 |
| 4,245,219 | 1/1981 | Dempsey et al. | 340/541 X |
| 4,311,889 | 1/1982 | Blanchard et al. | 340/565 X |
| 4,318,088 | 3/1982 | Hunter | 340/541 |
| 4,356,423 | 10/1982 | Gudzin | 340/665 X |
| 4,367,459 | 1/1983 | Amir et al. | 340/668 X |

FOREIGN PATENT DOCUMENTS

| | | | |
|---|---|---|---|
| 601871 | 7/1978 | Switzerland | 340/541 |

*Primary Examiner*—Jerry W. Myracle
*Assistant Examiner*—Tom Noland
*Attorney, Agent, or Firm*—Benjamin J. Barish

[57] ABSTRACT

An underground taut wire intrusion detection system includes a sensor wire enclosed within a conduit adapted to be buried in the ground, the conduit being sufficiently rigid so as to be collapse-resistant when buried in the ground, but being sufficiently flexible in its length such that when disturbed by an attempted intruder the disturbance is transferred to the sensor wire to cause it to actuate a detector.

16 Claims, 8 Drawing Figures

INTRUSION DETECTION SYSTEM

BACKGROUND OF THE INVENTION

The present invention relates to intrusion detection systems, and particularly to the taut wire type system which produces an electrical signal when a sensor wire is cut or disturbed.

Taut wire intrusion detection systems are now commonly used in security fences to detect an attempt to penetrate through or over the fence. However, the known systems do not detect an attempt to penetrate under the fence, e.g. by digging a tunnel, and therefore in high security places a barrier, such as a concrete wall, may have to be built under the ground below the fence to prevent such an attempted penetration. In addition, the known security fences usually do not detect the presence of a person near the fence, but rather detect his presence only when actual contact is made with the fence, e.g., by cutting or moving one of the sensor wires.

An object of the present invention is to provide an intrusion detection system having advantages in one or more of the foregoing respects. Another object of the invention is to provide an intrusion detection system particularly useful with security fences but which may also be used apart from security fences, to detect an attempted tunnelling into a protected area, or to detect the presence of a person near or in a protected area.

SUMMARY OF THE INVENTION

According to a broad aspect of the present invention, there is provided an underground intrusion detection system including a taut sensor wire buried in the ground and connected to an intrusion detector for detecting an attempted intrusion by producing an electrical signal when the sensor wire is cut or disturbed, characterized in that said sensor wire is tensioned between a pair of ground stakes buried in the ground and is enclosed within a conduit buried in the ground and having a longitudinal passageway of slightly greater inner diameter than the outer diameter of the sensor wire so that the sensor wire is freely movable therein. The conduit is sufficiently rigid to make said passageway collapse-resistant such that the conduit maintains the free movement of the sensor wire in its passageway when both the conduit and its sensor wire are buried in the ground, and is sufficiently flexible in its length to flex when disturbed by an attempted intruder to apply a force to the sensor wire and thereby to cause the sensor wire to actuate the detector.

A number of embodiments of the invention are described below for purposes of example.

According to one described embodiment, the system includes a plurality of said sensor wires buried at different depths in the ground, each sensor wire being enclosed, and freely movable, within its conduit for actuating the detector upon sensing an attempted deep-tunnel intrusion.

According to another described embodiment, the system includes a plurality of sensor wires buried in a predetermined area in the ground at different horizontal spacings from each other, each sensor wire being enclosed, and freely movable, within its conduit for actuating the detector upon sensing the weight of a person in said predetermined area.

According to another aspect of the present invention, there is provided an underground intrusion detection system as described above, in combination with an above-ground security fence, which fence includes a plurality of taut wires for detecting an intrusion over or through the fence, while the underground system acts as a vertical extension of the fence to detect an intrusion under the fence, or as a horizontal extension of the fence to detect an intrusion near the fence.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
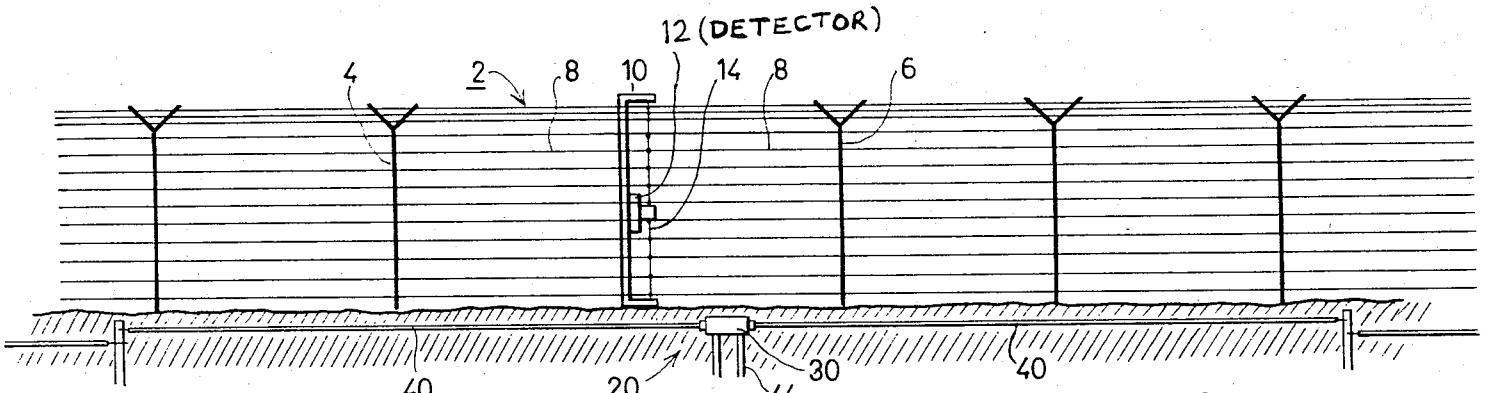
FIG. 1 illustrates one form of security fence type of intrusion detection system constructed in accordance with the present invention.

The intrusion detection system illustrated in FIG. 1 of the drawings is used with a security fence, generally designated 2, which may be of the type described, for example, in U.S. Pat. No. 4,367,459. A section of such a fence may include, for example, a pair of wire-supporting posts 4, 6 between which a group of sensor wires 8 are secured under tension; and an intermediate pole 10 carrying a detector 12, which detector is connected by a common actuator wire 14 to all the sensor wires 8, so that if one of the sensor wires is cut or disturbed, this would be sensed by the detector 12. For further details of the construction and operation of such a security fence, reference may be had to U.S. Pat. No. 4,367,459.

As indicated earlier, one of the problems in the use of such a security fence is an attempt to bypass the fence by digging a tunnel under it. Most of the security fences used today do not have effective protection against such a possibility; and those that do, usually do so by providing a barrier, such as a concrete wall, under the fence.

According to the present invention, the security fence 2 illustrated in FIG. 1 is protected against this possibility by an underground intrusion protection system, generally designated 20.

Figure 2:
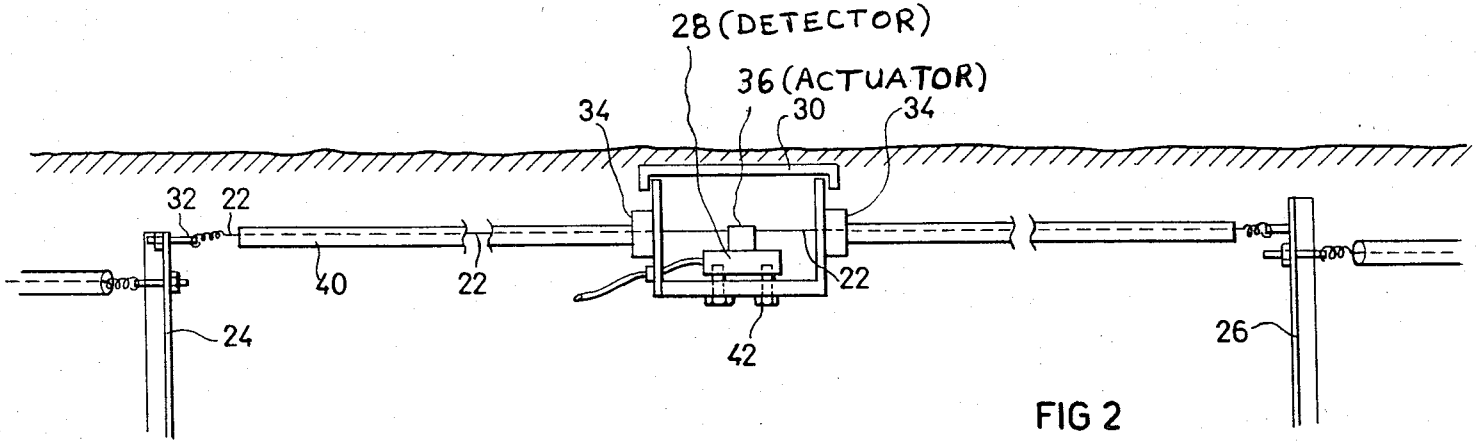
FIG. 2 is an enlarged fragmentary view of the underground portion of the intrusion detection system of FIG. 1.

The underground intrusion detection system is more particularly illustrated in FIG. 2. It includes taut sensor wires 22 secured in tension between ground stakes 24, 26 and connected to a detector 28 disposed within a housing 30, all buried underground. The outer ends of the taut sensor wires 22 are secured to the ground stakes by tensioning bolts 32 permitting adjustment of the tension applied to the wires. The inner ends of the sensor wires 22 are passed through sealed lead-in fittings 34 into the interior of housing 30 and are secured to an actuator 36 of the detector 28 so as to actuate the detector if a sensor wire 22 is cut or otherwise disturbed.

Each sensor wire 22 is disposed within a conduit 40 having a longitudinal passageway of slightly greater inner diameter than the outer diameter of the sensor wire, so that the sensor wire is freely movable within the conduit passageway with a relatively small clearance. Each conduit 40 extends for substantially the complete length of its sensor wire 22 externally of the detector housing 30. Thus, the inner ends of the conduits 40 do not enter the detector housing 30, but rather terminate at the sealed lead-in fittings 34 through which the sensor wires 22 pass into the housing. The outer ends of the conduits 40 terminate substantially at the ends of the wires 22 fastened via the tensioning bolts 32 to the ground stakes 24, 26.

Detector 28 is fixed within housing 30 by any suitable means, such as by bolts 42. The detector housing 30 is hermetically sealed so as to prevent the entry of dirt or moisture, and is also anchored in the ground by ground stakes 44.

Each conduit 40 is sufficiently rigid in the radial direction so as to make the passageway substantially collapse-resistant. Thus, the conduits 40 maintain the free movement of their sensor wires 22 within the conduit passageways when both the conduits and the sensor wires are buried in the ground. The conduits, however, are sufficiently flexible in their length so as to flex when disturbed by an attempted intrusion. Because of the free movement of the sensor wires 22 within their conduits 40, and the relatively small clearance between the sensor wires and their conduits, the flexing of the conduits causes them to apply a force to their sensor wires and, thereby, to actuate the detector 28.

As one example, the conduits 40 may be of relatively rigid polyvinyl chloride or polyethylene having an inner diameter of about 4 mm, and an outer diameter of 6 mm; and the sensor wires 22 may be of 2 mm stainless steel, thereby providing a clearance of about 1 mm on each side of the wire. The detector 28 may be any of the known types of disturbance detectors used in taut wire intrusion detection systems, such as electrical switches or force detectors. A piezoelectric type force detector, such as described in U.S. Pat. No. 4,367,459, is particularly preferred.

Figure 3:
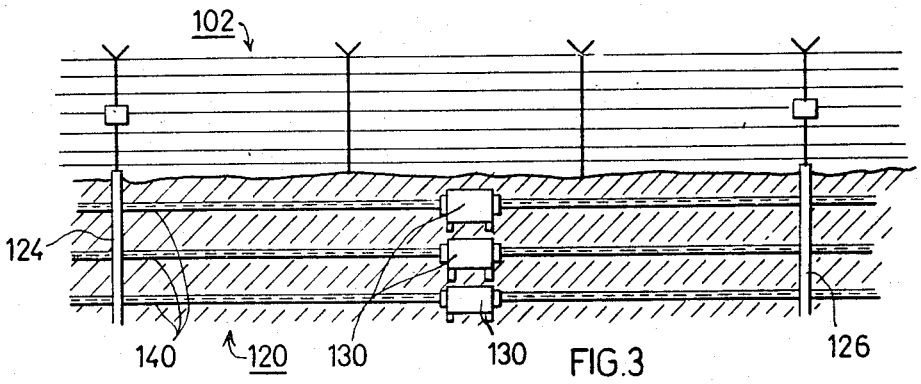
FIG. 3 illustrates another system constructed in accordance with the present invention particularly useful for detecting an attempted deep-tunnel intrusion.

FIG. 3 illustrates another embodiment of the invention, also including an over-ground security fence, generally designated 102, and an underground intrusion detection system, generally designated 120. In this embodiment, however, the underground intrusion detection system includes a plurality of sensor wires buried at different depths in the ground so as to detect an attempt to bypass the security fence 102 by digging a deep tunnel underneath it.

Thus, the underground intrusion detection system 120 illustrated in FIG. 3 comprises a plurality of the sensor wires each enclosed within a conduit 140, the sensor wires being tensioned between a pair of ground stakes 124, 126, and being connected to detectors within detector housings 130, all buried in the ground beneath the security fence 102. Preferably, as illustrated in FIG. 3, the sensor wires and their conduits 140 are vertically aligned with the security fence 102. It will thus be seen that if an attempt is made to penetrate the fence 102 by digging a deep tunnel under it, such an attempt will disturb one of the conduits 140, and thereby will cause its sensor wire to actuate the respective detector within one of the detector housings 130, in the same manner as described above with respect to the embodiment of FIGS. 1 and 2.

Figure 3A:
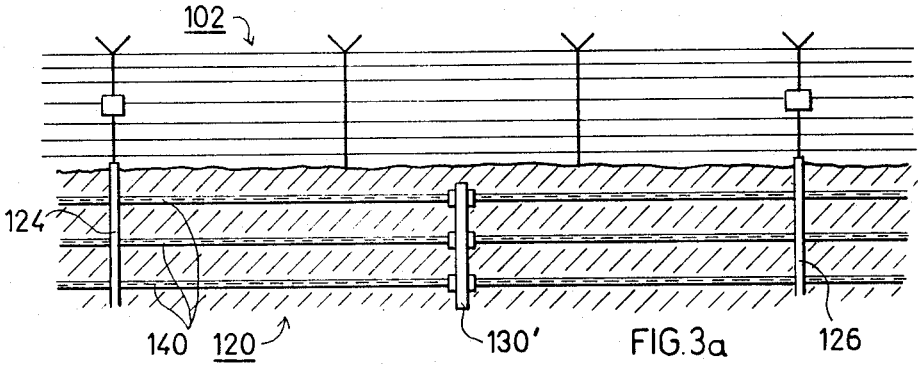
FIG. 3*a* illustrates a modification in the system of FIG. 3.

FIG. 3*a* illustrates a system substantially the same as in FIG. 3, and is therefore correspondingly numbered, except that the individual detector housings 130 in FIG. 3 are all accomodated in a common detector housing 130'.

Figure 4:
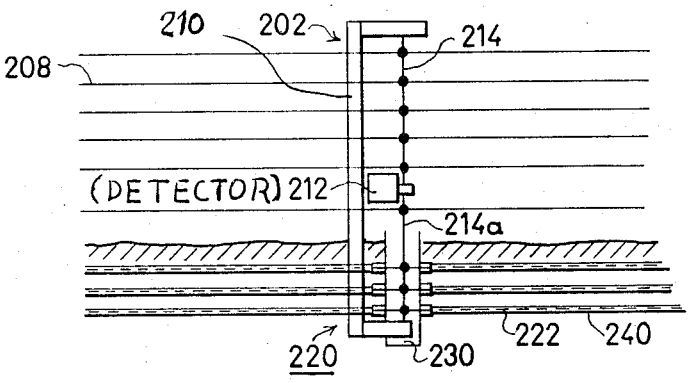
FIG. 4 illustrates another intrusion detection system for sensing an attempted deep-tunnel intrusion.

FIG. 4 illustrates a variation of the system of FIG. 3, in that the underground intrusion detection system, generally designated 220 in FIG. 4, does not include a separate detector, but rather uses the same detector provided in the over-ground security fence 202 for detecting an attempted intrusion under the fence. For this purpose, the detector 212 carried by its carrier pole 210 includes an extension 214*a* of its common actuator wire 214 extending into a housing, generally designated 230, in the ground and connected to the underground sensor wires 222 enclosed within the conduits 240 buried under the ground. Thus, detector 212 will be actuated in its normal manner by cutting or disturbing one of the sensor wires 208 in the above-ground fence 202 by virtue of the connection of the sensor wires to the detector by the common actuator wire 214, as described above with respect to FIGS. 1 and 2, and particularly as described in the above-cited U.S. Pat. No. 4,367,459. However, the same detector 212, by virtue of the common actuator wire extension 214*a* connected to the underground sensor wires 222, will also be actuated by the cutting or disturbance of one of the latter sensor wires, in the same manner as described above with respect to FIGS. 1 and 2.

Figure 5:
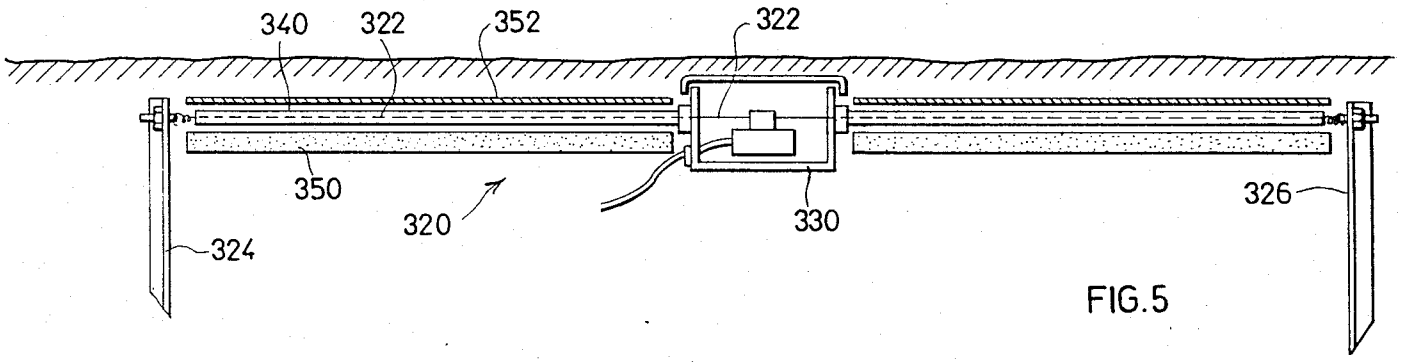
FIGS. 5 and 6 are side elevational and plan views, respectively, illustrating another embodiment of the invention particularly useful for detecting the presence of a person in a protected area, particularly near a security fence.
Figure 6:
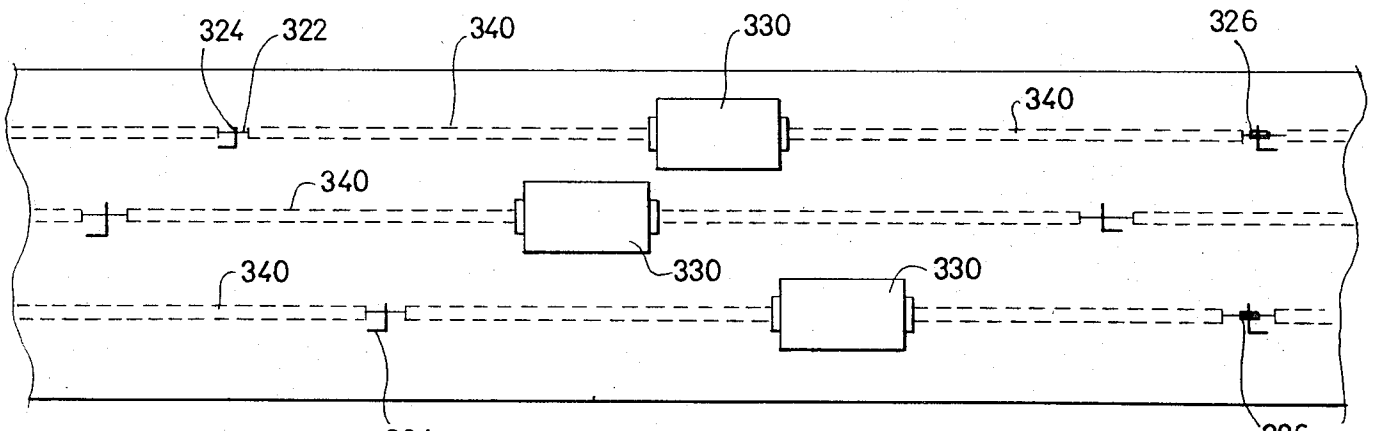

FIGS. 5 and 6 illustrate a further embodiment of the invention particularly useful for detecting the presence of a person near a security fence, i.e., even before he actually makes contact with the fence. For simplification purposes, the over-ground security fence is not illustrated in FIGS. 5 or 6, these figures illustrating only the underground intrusion detection system to be used near a fence, or in any other sensitive area where it is desired to detect the presence of a person.

Thus, the underground intrusion detection system illustrated in FIGS. 5 and 6, therein generally designated 320, comprises a plurality of lines of sensor wires 322, each enclosed within a conduit 340 buried in the ground at different horizontal spacings from each other, and each connected to a detector disposed within a housing 330 also buried in the ground. Each line of sensor wires is connected to the detector in one of the housings 330 and is tensioned between a pair of ground stakes 324, 326, so that each sensor wire is effective to sense a disturbance of its outer conduit 340 in the same manner as described above with respect to the embodiment of FIGS. 1 and 2. However, the embodiment of FIGS. 5 and 6 is particularly intended to detect the presence of a person by his weight, and for this purpose the system of FIGS. 5 and 6 includes a lyaer 350 of soft cushioning material underlying each of the conduits 340 so as to produce a displacement of the conduit in the vertical direction when the weight of a person is applied over the conduit. The cushioning layer 350 is preferably also resilient, such as being made of sponge elastomeric material, so as to return to its normal condition. It may be of any desired thickness to produce the desired degree of displacement of the conduit and its sensor wire when stepped on by a person.

Preferably, a sheet 352 of relatively rigid material, such as rigid polyvinyl chloride, is applied over all the conduits 340 in order to distribute, horizontally over all the conduits 340, the weight of a person when stepping on the ground overlying one of the conduits. The provision of the overlying rigid sheet 352 thus permits a larger horizontal area to be covered with a minimum number of sensor wires and detectors, while avoiding the possibility that the presence of a person may not be detected if applied between a line of such sensor wires and detectors.

Figure 7:
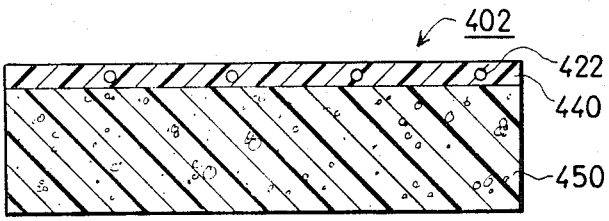
FIG. 7 illustrates a modification in the structure of the system of FIGS. 5 and 6.

FIG. 7 illustrates a variation in the system of FIGS. 5 and 6, wherein the conduits for the sensor wires, the rigid overlying sheet, and the underlying resilient cushioning layer, are all embodied in one structural unit. This structural unit is generally designated 402 in FIG. 7, and includes an overlying relatively rigid sheet 440 formed with passageways 422 for the sensor wires, and an underlying layer 450 of resilient cushioning material, e.g. of sponge elastomeric material. For example, the overlying layer 440 may be of relatively rigid polyvinyl chloride sheet material, of sufficient thickness so as to provide the above-described properties of the conduits 40 in FIGS. 1 and 2, namely, sufficient rigidity in the radial direction to prevent the collapse of its passageways, and sufficient flexibility in the longitudinal direction to permit it to flex when subjected to the weight of a person. This flexing of the sheet is enhanced by the underlying layer 450 of resilient cushioning material.

It will thus be seen that underground intrusion detection systems described above are particularly useful with over-ground security fences, in which case they serve as an extension of the security fence either in the vertical direction (FIGS. 1–4) to prevent by-passing the fence by digging a tunnel under it, or in the horizontal direction (FIGS. 5–7) to detect the presence of a person near the fence. It will also be appreciated that the described underground detection systems may also be used apart from security fences to detect an attempted tunnelling into a restricted area, or to detect the presence of a person near the restricted area. It will also be appreciated that the arrangement illustrated in FIG. 4, wherein the underground intrusion detection system uses the detectors of the over-ground security fence, may also be applied with respect to the arrangements of FIGS. 1–3 and 5–7. Finally, it will be appreciated that the foregoing arrangements can also be used to provide over-ground protection, for example in the presence of snow or ice.

Many other variations, modifications and applications of the invention will be apparent.

What is claimed is:

1. An underground intrusion detection system including a taut sensor wire buried in the ground and connected to an intrusion detector for detecting an attempted intrusion by producing an electrical signal when the sensor wire is cut or disturbed, characterized in that said sensor wire is tensioned between a pair of ground stakes buried in the ground and is enclosed within a conduit buried in the ground and having a longitudinal passageway of slightly greater inner diameter than the outer diameter of the sensor wire so that the sensor wire is freely movable therein, said conduit being sufficiently rigid to make said passagway collapse-resistant such that the conduit maintains the free movement of the sensor wire in its passageway when both the conduit and its sensor wire are buried in the ground, said conduit being sufficiently flexible in its length to flex when disturbed by an attempted intruder to apply a force to the sensor wire and thereby to cause the sensor wire to actuate the detector.

2. The system according to claim 1, wherein at least one end connection of the sensor wire to a ground stake includes variable tensioning means for varying the tautness of the sensor wire.

3. The system according to claim 2, wherein said detector is enclosed within a rigid housing also buried in the ground, said sensor wire passing through said housing and being connected to said detector within said housing.

4. The system according to claim 3, wherein each portion of said sensor wire extending from its respective side of the detector housing to the respective ground stake is covered by a separate section of said conduit, each section being connected at one end to a fitting on the detector housing forming a sealed lead-in for the sensor wire.

5. The system according to claim 4, wherein said detector housing includes one or more ground stakes for anchoring same in the ground.

6. The system according to claim 1, wherein there are a plurality of said sensor wires buried at different depths in the ground, each sensor wire being enclosed, and freely movable, within its conduit for actuating the detector upon sensing an attempted deep-tunnel intrusion.

7. The system according to claim 6, wherein each of said plurality of sensor wires is connected to a separate detector.

8. The system according to claim 6, wherein said plurality of sensor wires are connected to a common detector.

9. The system according to claim 1, wherein there are a plurality of said sensor wires buried in a predetermined area in the ground at different horizontal spacings from each other, each sensor wire being enclosed, and freely movable, within its conduit for actuating the detector upon sensing a predetermined weight on said predetermined area.

10. The system according to claim 9, wherein each of said conduits is a separate hollow tube and is supported on an underlying layer of resilient cushioning material to facilitate the displacement thereof under the weight of a person in said predetermined area.

11. The system according to claim 10, further including a rigid sheet overlying said hollow tubes to transmit thereto the force exerted by the weight of a person in said predetermined area.

12. The system according to claim 9 wherein said plurality of sensor wires are disposed in a common conduit formed with a plurality of separate passageways for the sensor wires.

13. The system according to claim 12, wherein said common conduit is of relatively rigid plastics material and includes an underlying layer of resilient cushioning material.

14. The system according to claim 9, in combination with a security fence above the ground which fence includes a plurality of further taut sensor wires for detecting an attempted intrusion through the fence, while said first-mentioned taut sensor wires detect the presence of a person near the fence.

15. The system according to claim 1, in combination with a security fence above the ground which fence includes a plurality of further taut sensor wires for detecting an attempted intrusion through the fence, while said fist-mentioned taut sensor wire detects an attempted intrusion under the fence.

16. The system according to claim 1, wherein said detector is a force detector.

* * * * *